US008235872B2

(12) United States Patent
Perry

(10) Patent No.: US 8,235,872 B2
(45) Date of Patent: Aug. 7, 2012

(54) WEIGHTLIFTING GRIP

(76) Inventor: Kent Perry, Temecula, CA (US)

( * ) Notice: Subject to any disclaimer, the term of this patent is extended or adjusted under 35 U.S.C. 154(b) by 0 days.

(21) Appl. No.: 12/951,055

(22) Filed: Nov. 21, 2010

(65) Prior Publication Data

US 2012/0129664 A1 May 24, 2012

(51) Int. Cl.
*A63B 21/00* (2006.01)

(52) U.S. Cl. ..... 482/49; 482/93

(58) Field of Classification Search ..... 482/49; 473/568, 549–552, 301, 302, 300, 303; 74/551.9; 81/489.492; D08/6, 7, 8; 2/161
See application file for complete search history.

(56) References Cited

U.S. PATENT DOCUMENTS

| | | | | |
|---|---|---|---|---|
| 5,479,660 | A * | 1/1996 | Najac | 2/20 |
| 5,603,679 | A * | 2/1997 | Reis | 482/106 |
| 6,558,270 | B2 * | 5/2003 | Kwitek | 473/301 |
| 7,232,352 | B2 * | 6/2007 | Splaine | 440/101 |
| 7,487,553 | B2 * | 2/2009 | Price | 2/161.1 |

* cited by examiner

*Primary Examiner* — Jerome W Donnelly
(74) *Attorney, Agent, or Firm* — Jerry D Haynes; Law Office of Jerry D Haynes

(57) ABSTRACT

The present invention relates to a handgrip for weightlifting purposes comprising: a first surface for contact with a bar; a second surface for direct contact with a user's hand; and four corners creating a substantially parallelogram shape, where one opposite pair of corners form an angle that is less than a 90° angle and a second opposite pair of corners form an angle that is greater than a 90°, angle. The handgrip according to the present invention securely fits around the bar where said bar is a part of a barbell or dumbbell. The handgrip conforms to a substantially cylindrical shape when the user places it around the bar.

13 Claims, 5 Drawing Sheets

WEIGHTLIFTING GRIP

BACKGROUND OF INVENTION

1. Field of Invention

The present invention relates to a gripping device for use in weightlifting.

2. Description of Related Art

Exercise and fitness is a prevalent part of many individual's lives. Many forms of exercise exist in order for one to main their fitness level including jogging, weightlifting, exercise machines, aerobics, yoga, bicycling or swimming. Weightlifting in particular provides various benefits to the participants such as weight loss, improved muscle tone and increased strength. Weightlifting is typically accomplished by using either weight machines or free weights. Free weights are handled on barbells or dumbbells. One of the drawbacks, however, to weightlifting is the development of calluses and the risk of blisters on the individual's hand. Many of the barbells and dumbbells used are made of metal therefore lifting of the weights may cause injury to the user's hands.

Weightlifting gloves have been developed which are used by many weightlifters in order to alleviate some of the drawbacks associated with weightlifting. Many of the weightlifting gloves are leather gloves that fit over the hand and have additional padding on the palm portion in order to provide protection and comfort for the user. Many of the gloves used for weightlifting do not enclose the entire hand and frequently allow the fingers to remain open. Other means that address this problem include the use of grips specifically designed to provide padding for the palm area of a weightlifter. Many of the grips designed are held in place through the use of finger loops or wrist bands that wrap the grips around the hand and allow the grip to cover the exposed palm. One of the drawbacks of using the existing gripping devices is the inability for the grip to remain stable while the weightlifter is performing their exercise.

One example of a palm grip is U.S. Pat. No. 5,603,679 which discloses the use of a gripping device which consists of a single resilient flexible pad formed of a flat sheet of elastomeric material such as rubber, latex or the like. This gripping device relies on the hand gripping pressure to remain in a stable position to sufficiently pad the hand. Such a grip, however, may have a tendency to fail after repeated use and would lose stability over a period of time. Various portions of the palm are exposed during exercise. Another drawback to this particular palm grip is that the palm core must be strapped onto the hand using a strap that may diminish its stability over a period of time over repeated use.

U.S. Pat. No. 5,479,660 discloses an exercise glove that uses a pair of straps to hook and loop connectors around the back portion of the hand and provides a palm structure that covers the palm of the hand in order to provide a gripping pad. This particular gripping pad shares some of the drawbacks mentioned with the above prior art in that the pad itself may diminish in its ability to remain stable over a period of time and the pad itself must be strapped onto the hand of the user.

Consequently it is advantageous to provide a gripping pad that overcomes some of the drawbacks of the prior art and provides the weightlifter with maximum protection and the greatest flexibility in use.

SUMMARY OF THE INVENTION

The present invention relates to a handgrip for weightlifting purposes comprising: a first surface for contact with a bar; a second surface for direct contact with a user's hand; and four corners creating a substantially parallelogram shape, where one opposite pair of corners form an angle that is less than a 90° angle and a second opposite pair of corners form an angle that is greater than a 90°, angle. The handgrip according to the present invention securely fits around the bar where said bar is a part of a barbell or dumbbell. The handgrip conforms to a substantially cylindrical shape when the user places it around the bar.

In an alternative embodiment, the present invention relates to a handgrip for weightlifting purposes comprising: a first surface for contact with a bar; a second surface for direct contact with a user's hand; and four corners where at least one corner is less than a 90° angle and the remaining corners are at about 90°, further where the handgrip is shaped in a substantially cylindrical shape. A weightlifter may securely place the handgrip around the bar of a barbell or a dumbbell. The at least one corner that is less than a 90° angle extends outward from an abutting corner when the handgrip is placed around the bar and provides surface protection for the weightlifter's thumb.

The present invention also discloses a handgrip system for weightlifting purposes comprising: a left-handed grip, where the left-handed grip includes four corners and at least one corner is less than a 90° angle and the remaining corners are at about 90°, further where the left-handed grip is shaped in a substantially cylindrical shape; and a right-hand grip, where the right-handed grip includes four corners and at least one corner is less than a 90° angle and the remaining corners are at about 90°, further where the right-handed grip is shaped in a substantially cylindrical shape. A weightlifter uses the handgrip system by placing the left-handed grip and the right-handed grip around the bar of a barbell or dumbbell. The at least one corner less than a 90° angle of both the left-handed grip and right-handed grip extends outward from an abutting corner when each respective handgrip is placed around the bar and provides surface protection for the weightlifter's thumbs.

Another exemplary embodiment of the present invention includes a handgrip for weightlifting purposes comprising: a first surface for contact with a bar; a second surface for direct contact with a user's hand; and four corners, where the corners are at about 90°, further where the handgrip is shaped in a substantially cylindrical shape. In this particular embodiment, the handgrip securely fits around the entire circumference of the bar of a barbell or a dumbbell. Alternatively, the handgrip of this embodiment may securely fit around a portion of the circumference of the bar of a barbell or a dumbbell. The handgrip of this embodiment is made of a sufficient width to protect the palm of a weightlifter.

DETAIL DESCRIPTION

Figure 1A:
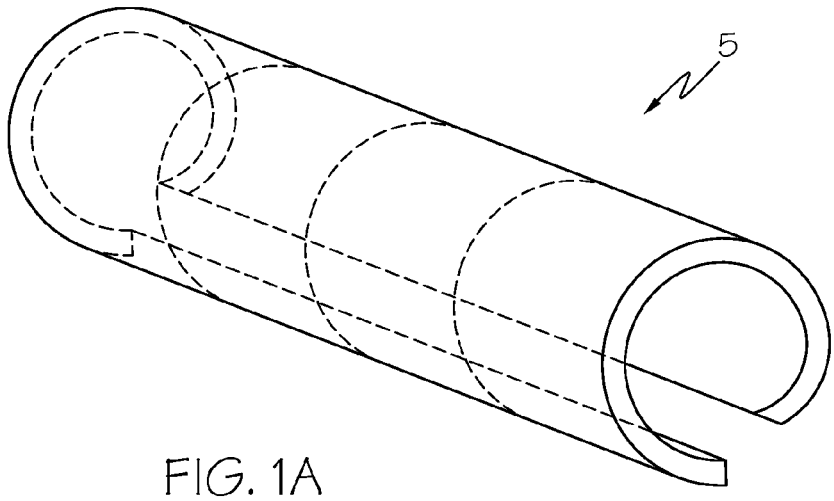
FIG. 1A shows a handgrip according to the present invention.
Figure 1B:
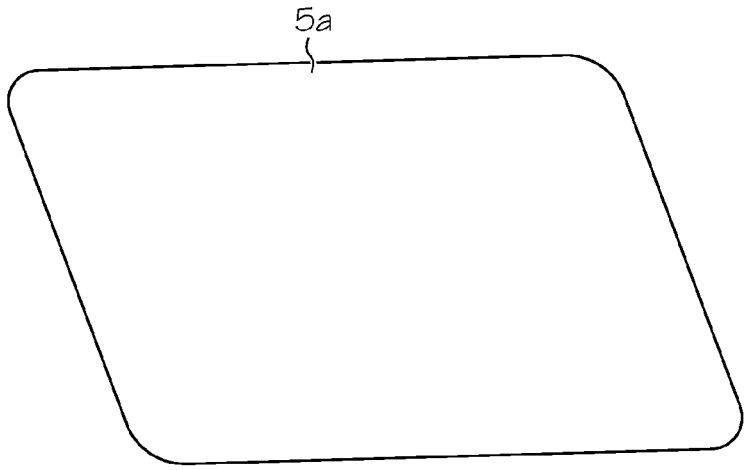
FIG. 1B shows a dimensional view of the handgrip according to the present invention.

The present invention provides a grip to use when weightlifting with free weights. The grip wraps around a barbell or dumbbell that the user may be lifting at the time of exercise. The present invention provides a grip that is resilient and flexible in use. The present invention also provides sufficient protection of the weightlifter's hands from abrasions and calluses while lifting weights. FIG. 1A shows a prospective view of a handgrip 5 according to the present invention. As shown, the handgrip 5 has a substantially cylindrical shape so that it may surround a portion of the bar of a barbell or dumbbell while the user grips the bar. The user maintains a grip on the bar by using the handgrip 5. FIG. 1B shows a flat dimensional view the handgrip 5 according to the present invention. The handgrip 5 has a substantially parallelogram shape that includes 2 pair of opposite angles that are substantially equal. One pair of the angles is less than 90 degrees and a second pair is greater than 90 degrees. The shape of the handgrip 5 provides for maximum covers for the user's palm when applied to a bar and used for gripping purposes. Surface 5*a* is the outside surface of handgrip 5 and conforms to the user's hand once the user applies a firm grip.

Figure 2A:
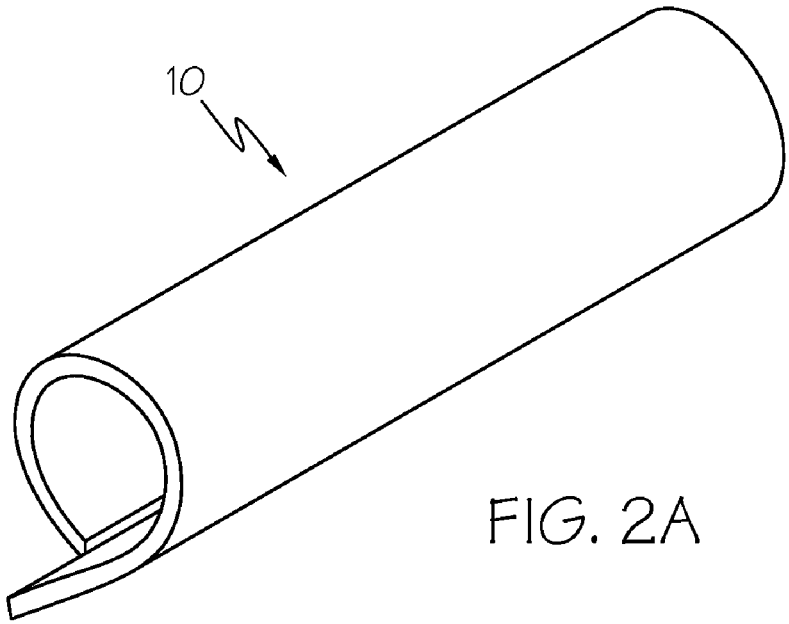
FIG. 2A shows a left-handed handgrip according to the present invention.
Figure 2B:
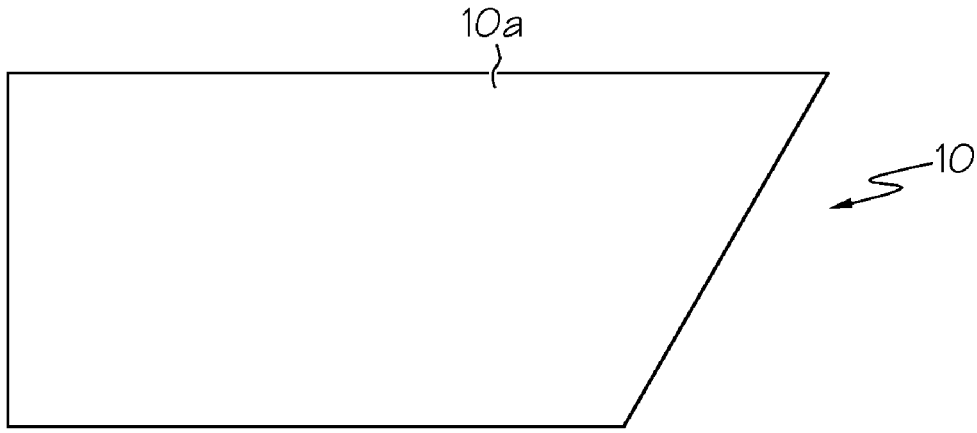
FIG. 2B shows a dimensional view of the left-handed handgrip according to the present invention.

Shown in FIG. 2A is a prospective view of a left-handed grip 10 according to the present invention. The left-handed grip of FIG. 2A is curved and semi-cylindrical. As shown, the grip 10 has one end that extends outwardly from the cylindrical circle that it forms. This one particular end that extends outwardly provides for increased coverage for the thumb of a individual's left hand. FIG. 2B shows a flat dimensional view of the left-handed grip according to the present invention. The surface 10*a* shown in FIG. 2B is the outside surface of the grip 10. This outside surface conforms to the palm of the weightlifter when in use. The left-handed grip 10 curls around a barbell or a dumbbell and completely encloses the dumbbell or the barbell at the particular section that the weightlifter is gripping.

Figure 3A:
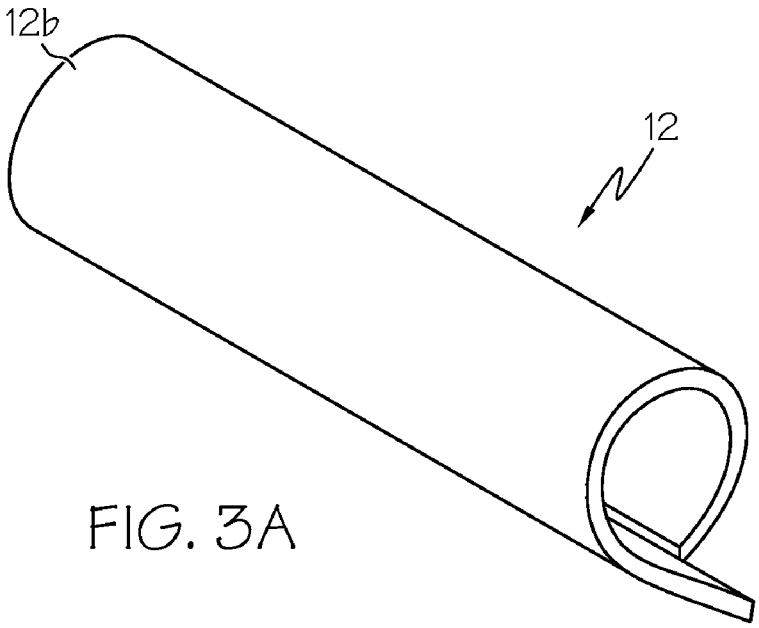
FIG. 3A shows a right-handed handgrip according to the present invention.
Figure 3B:
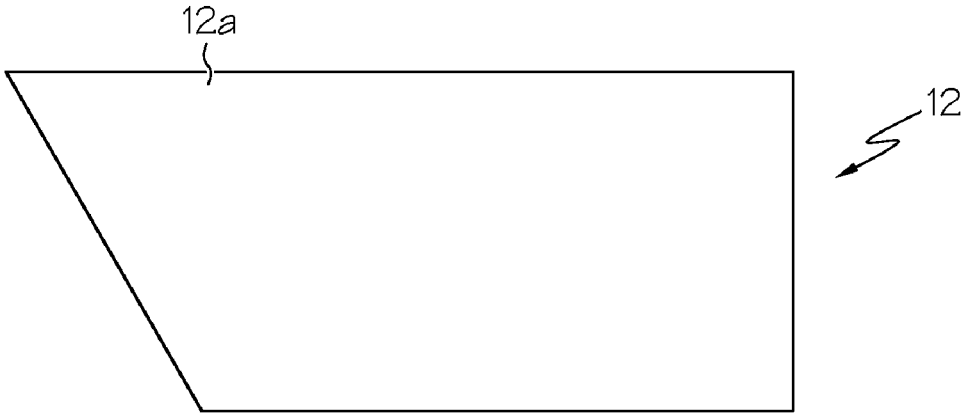
FIG. 3B shows a dimensional view of the right-handed handgrip according to the present invention.

FIG. 3A shows a right-handed grip 12 according to the present invention. The right-handed grip 12 includes an outside surface 12*b* shown in FIG. 3A. This outside surface provides a pad and grip for the right hand of a weightlifter. Similar to the left handgrip 10 the right handgrip 12 totally surrounds the barbell at the particular position that the weightlifter is placing their hand during the exercise. FIG. 3B shows the dimensional view of the right-handed grip 12 in a flat form and depicts inside surface 12*a* of the right handgrip 12. The right-handed grip 12 and the left handgrip 10 may be used in conjunction when performing lifting with a barbell or dumbbell. These two grips are capable of being wrapped around the barbell at the various locations as desired by the weightlifter.

Figure 4A:
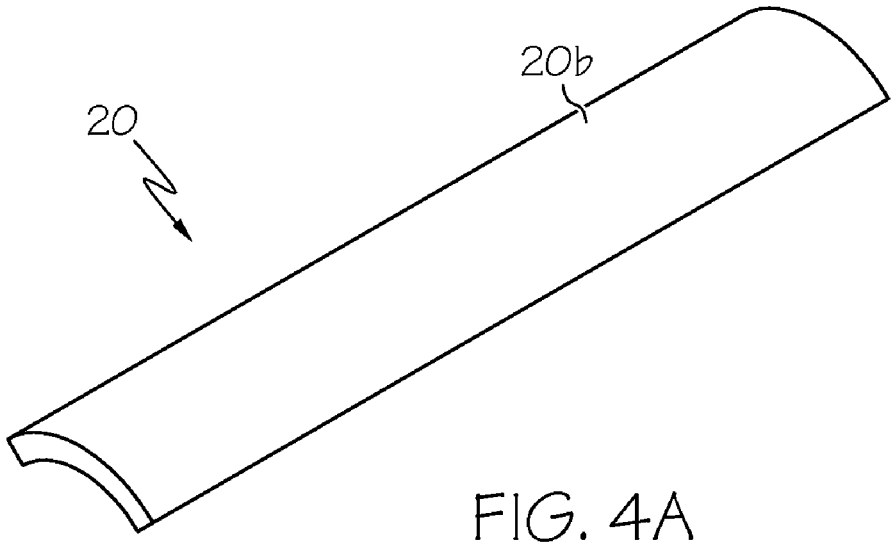
FIG. 4A shows a bottom view of an alternative handgrip according to the present invention.
Figure 4B:
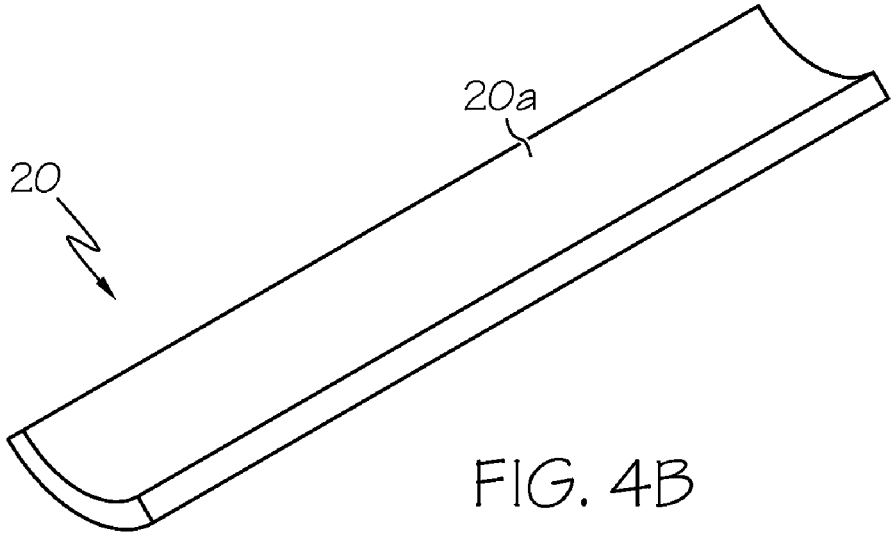
FIG. 4B shows an inside view of the alternative grip according to the present invention.

FIG. 4A shows an alternative embodiment of the grip according to the present invention. Quarter grip 20 is shown in FIG. 4A provides a smaller version of the grip according to the present invention. The quarter grip 20 specifically provides protection for the metacarpal section of the hand when used with a barbell. Surface 20*b* is the outside surface of the quarter grip 20 which directly contacts the weightlifter's hand. The reverse side of 20*a* contacts the barbell or dumbbell used by the weightlifter shown in FIG. 4B. This particular embodiment of the present invention provides a smaller but yet effective grip that provides the weightlifter with padding in the critical area of the hand while performing exercises.

Figure 5:
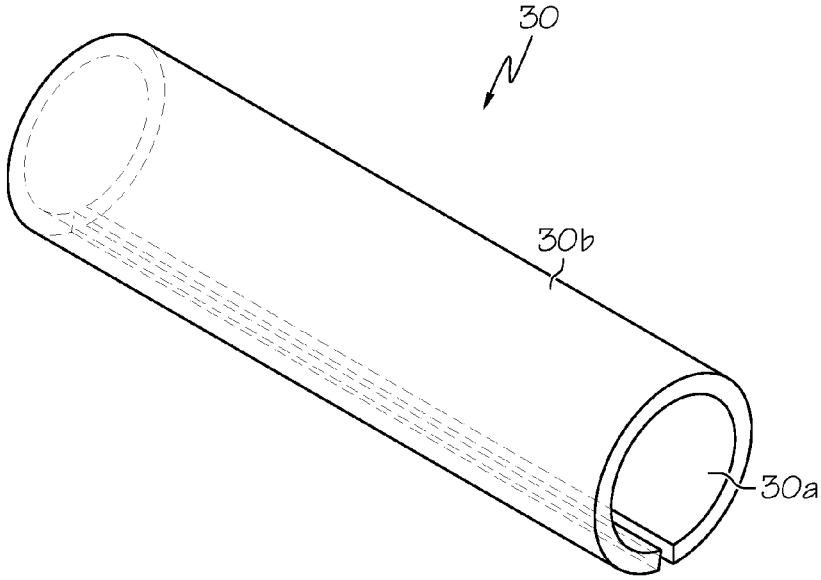
FIG. 5 shows a handgrip with an alternative dimensional perspective according to the present invention.

FIG. 5 shows a fourth embodiment of the grip according to the present invention. A grip 30 shown in FIG. 5 is cylindrical in nature similar to the offset embodiments described above. The grip 30 however does not have the offset dimensional characteristic associated with the grip of the previously described embodiments. It is completely cylindrical and wraps around the barbell to be used by the weightlifter. In this particular embodiment, the width of the grip would be sufficient in order to provide coverage from a weightlifter's outside thumb to the outside of the fourth finger. Also this particular embodiment of the grip may be used with either hand since it does not provide the offset that is associated with the previous embodiments.

The present invention provides a flexible grip that is easily placed around the barbell in order to provide the user both comfort and control while lifting weights. The cushioning support provided by the present invention therefore may reduce the development of calluses and/or blisters on the palms of the hands of a weightlifter. Materials that are used to manufacture the grip according to the present invention may include molded polypropylene or a neoprene material that conforms to the user's hand. The grip is also contemplated to provide superior cushioning as opposed to the prior art in providing more durable product than known in the prior art.

The instant invention has been shown and described in what is considered to be the most practical and preferred embodiments. It is recognized, however, that departures may be made there from within the scope of the invention and that obvious modifications will occur to a person skilled in the art.

What is claimed is:

1. A handgrip for weightlifting purposes comprising:

a first surface for contact with a bar;

a second surface for direct contact with a user's hand, where the second surface conforms to the palm of the user's hand;

four corners forming a quadrilateral shape for the handgrip; and at least one outward extending corner from the four corners, where the outward extending corner provides surface protection for the user's thumb, and where the outward extending corner is less than a 90° angle and the remaining corners are at about 90°, wherein the handgrip is shaped in a substantially cylindrical shape when wrapped around the bar, and where the handgrip is made from one of at least polypropylene and neoprene.

2. The handgrip according to claim 1, where the handgrip securely fits around the bar where said bar is a part of a barbell.

3. The handgrip according to claim 1, where the handgrip fits around the bar where said bar is a part of a dumbbell.

4. A handgrip system for weightlifting purposes comprising:

a left-handed grip comprising a quadrilateral shape, where the left-handed grip includes four corners comprising:

at least one corner less than a 90° angle, where the at least one corner outwardly extends from an abutting corner when the left-hand grip is placed in a substantially cylindrical shape around a bar to provide surface protection for the user's thumb, the remaining corners are at about 90°, and where the left hand grip is made from one of at least polypropylene and neoprene; and a right-hand grip comprising a quadrilateral shape, where the right-handed grip includes four corners comprising:

at least one corner less than a 90° angle, where the at least one corner outwardly extends from an abutting corner when the right-hand grip is placed in a substantially cylindrical shape around a bar to provide surface protection for the user's thumb, the remaining corners are at about 90°, and where the right hand grip is made from one of at least molded polypropylene and neoprene.

5. The handgrip system according to claim 4, wherein a weightlifter places the left-handed grip and the right-handed grip around the bar of at least one of a barbell and dumbbell.

6. A handgrip for weightlifting purposes comprising:

a first surface placed in contact with a bar;

a second surface for direct contact with a user's hand, where the second surface conforms to the palm of the user's hand; and four corners, where the four corners create a substantially parallelogram shape, where one opposite pair of corners form an angle that is less than a 90° angle to extend from the handgrip and provide a surface protection for the user's thumb, and a second opposite pair of corners form an angle that is greater than a 90° angle, further where the handgrip is shaped in a substantially cylindrical shape, and where the where the handgrip is made from one of at least polypropylene and neoprene.

7. The handgrip according to claim 6, where the handgrip securely fits around the entire circumference of a bar where said bar is a part of at least one of a barbell and a dumbbell.

8. The handgrip according to claim 6, where the handgrip securely fits around a portion of the circumference of a bar where said bar is a part of at least one of a barbell and a dumbbell.

9. The handgrip according to claim 7, where said handgrip is a sufficient width to protect the palm of a weightlifter.

10. The handgrip according to claim 8, where said handgrip is a sufficient width to protect the metacarpal of a weightlifter's hand.

11. The handgrip according to claim 1, wherein the four corners create a substantially parallelogram shape when the hand grip is in a flat form, where one opposite pair of corners form an angle that is less than a 90° angle and a second opposite pair of corners form an angle that is greater than a 90°, angle.

12. The handgrip according to claim 11, where the handgrip securely fits around the bar where said bar is a part of a barbell, and the handgrip conforms to a substantially cylindrical shape.

13. The handgrip according to claim 11, where the handgrip fits around the bar where said bar is a part of a dumbbell, and the handgrip conforms to a substantially cylindrical shape.

* * * * *